US007703538B2

(12) United States Patent
Johnson et al.

(10) Patent No.: US 7,703,538 B2
(45) Date of Patent: Apr. 27, 2010

(54) ACCESS APPARATUS FROM A TUBULAR INTO A DOWNHOLE HYDRAULIC CONTROL CIRCUIT AND ASSOCIATED METHOD

(75) Inventors: Janice R. Johnson, Houston, TX (US); James G. King, Kingwood, TX (US)

(73) Assignee: Baker Hughes Incorporated, Houston, TX (US)

( * ) Notice: Subject to any disclaimer, the term of this patent is extended or adjusted under 35 U.S.C. 154(b) by 179 days.

(21) Appl. No.: 11/473,741

(22) Filed: Jun. 23, 2006

(65) Prior Publication Data

US 2007/0295511 A1 Dec. 27, 2007

(51) Int. Cl.
*E21B 34/10* (2006.01)
*E21B 17/00* (2006.01)

(52) U.S. Cl. ..... 166/375; 166/242.1; 166/242.3; 166/55.7

(58) Field of Classification Search ..... 166/242.1, 166/242.3, 374, 375, 166, 55.7, 55.2, 55.1; 137/68.11, 797
See application file for complete search history.

(56) References Cited

U.S. PATENT DOCUMENTS

| | | | | |
|---|---|---|---|---|
| 2,191,750 | A * | 2/1940 | Brown | 166/63 |
| 2,322,694 | A * | 6/1943 | Kinzbach | 166/55.7 |
| 3,231,019 | A * | 1/1966 | Clay et al. | 166/287 |
| 4,373,587 | A | 2/1983 | Pringle | |
| 4,944,351 | A | 7/1990 | Eriksen et al. | |
| 5,496,044 | A * | 3/1996 | Beall et al. | 277/336 |
| 5,711,351 | A * | 1/1998 | Wheatley | 138/97 |
| 5,799,949 | A * | 9/1998 | Beall et al. | 277/300 |
| 5,899,796 | A * | 5/1999 | Kamiyama et al. | 451/61 |
| 6,260,850 | B1 * | 7/2001 | Beall et al. | 277/314 |
| 6,283,477 | B1 * | 9/2001 | Beall et al. | 277/314 |
| 6,629,565 | B2 * | 10/2003 | Harrell | 166/361 |
| 6,659,185 | B2 * | 12/2003 | Dennistoun et al. | 166/375 |
| 6,742,595 | B2 * | 6/2004 | Dennistoun et al. | 166/375 |
| 6,953,093 | B2 | 10/2005 | Dennistoun et al. | |

(Continued)

FOREIGN PATENT DOCUMENTS

GB 2291909 A 2/1996

(Continued)

OTHER PUBLICATIONS

Abou-Sayed, Omar A., et al., "Development of a Through-Flow-Line (TFL)-Deployed Insert Subsurface-Controlled Subsurface Safety Valve", SPE 62956, Oct. 2000. 1-11.

(Continued)

*Primary Examiner*—David J Bagnell
*Assistant Examiner*—Cathleen R Hutchins
(74) *Attorney, Agent, or Firm*—Steve Rosenblatt

(57) ABSTRACT

Access to a downhole tool through a tubular wall is created with a penetration tool into a surrounding annular chamber. The chamber is disposed around a tool joint between the end connection leaving an annular chamber that is of considerable length and allowing penetration anywhere along such length. The need to precisely position the penetration tool, as in past designs of annular chambers disposed within a pin and box connection is eliminated. Landing shoulders for the penetrating tool are also not required as the long length of the annular chamber allows surface personnel to sufficiently and accurately place the penetration tool somewhere along the length of the annular chamber.

13 Claims, 1 Drawing Sheet

U.S. PATENT DOCUMENTS

| | | | | |
|---|---|---|---|---|
| 2003/0234104 | A1* | 12/2003 | Johnston et al. | 166/298 |
| 2004/0056224 | A1* | 3/2004 | McVicker | 251/62 |
| 2005/0098325 | A1 | 5/2005 | Myerley et al. | |
| 2006/0048935 | A1* | 3/2006 | Kristiansen | 166/242.1 |

FOREIGN PATENT DOCUMENTS

| | | | |
|---|---|---|---|
| GB | 2302110 | A | 1/1997 |

OTHER PUBLICATIONS

Zakarian, Erich, et al., "A Systematic Investigation of Girassol Deepwater Field Operational Data to Increase Confidence in Multiphase Simulation", IPTC 11379. Dec. 2007, 1-9.

Coronado, Martin P., et al. "Advanced Openhole Completions Utilizing a Simplified Zone Isolation System", SPE 77438, Sep. 2002,1-11.

Kinnear, M.R., et al., "Repair of Failed Gas Lift Completion Using a 1500 Ft. Long Coiled Tubing Insert Straddle", SPE 36908, Oct. 1996, 1-9.

* cited by examiner

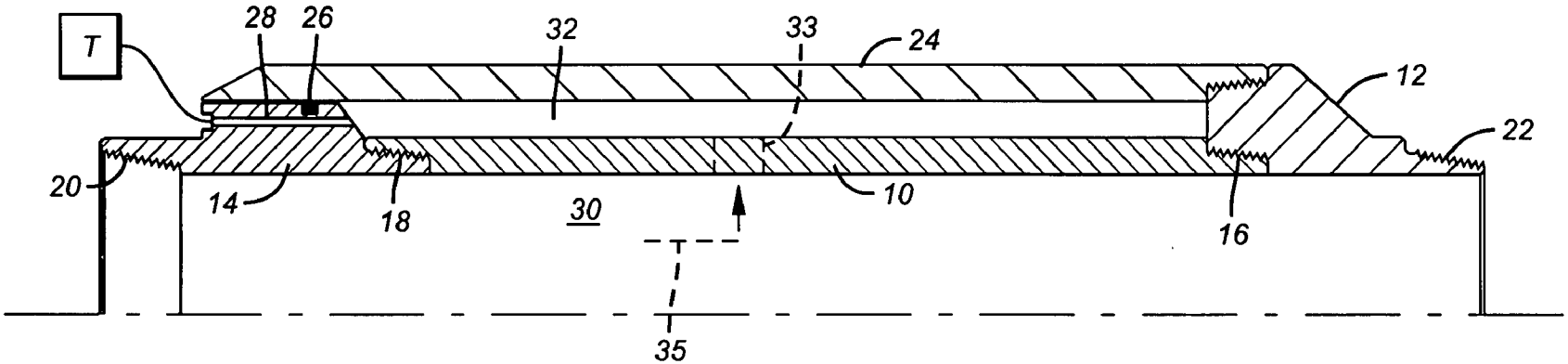
22
12
16
24
10
33
35
30
32
18
26
28
14
T
20

ACCESS APPARATUS FROM A TUBULAR INTO A DOWNHOLE HYDRAULIC CONTROL CIRCUIT AND ASSOCIATED METHOD

FIELD OF THE INVENTION

The field of the invention relates to access to a control system for a downhole tool and more particularly to ways to make access simpler than current designs.

BACKGROUND OF THE INVENTION

Many downhole tools are operated with hydraulic pressure delivered from the surface through a control line that runs along on the outside of a tubing string. One typical application is a sub surface safety valve. At times such valves fail and another valve is delivered on top to replace the defective safety valve. However, in order to make the replacement operate, access to the control system for the original valve had to be provided for the replacement valve. This was accomplished using an annular chamber that was formed within a pin and box connection providing a short length of circumferential thin wall through which a perforating tool had to penetrate for access to the control system. Such designs are illustrated in U.S. Pat. No. 5,496,044; 5,799,949 and 6,260,850. The problem with this design is the short height of the annular chamber, about ½ inch long, required the penetrating tool to be specifically placed on a locating shoulder so the penetrating device would go through at a precise location aligned with the annular chamber. Many times with the well containing contaminants such as paraffin or other debris, it was difficult to properly land the penetrating tool in the proper position to strike through the tubular wall and into the annular chamber. This condition is described in conjunction with subsurface safety valves but is applicable to a variety of downhole tools that need pressure access to a chamber to operate the tool in some way. For example, a production string packer has used the annular chamber described in the patents above to pressurize a piston to release the set of the packer. Other downhole tool applications are contemplated for this access issue through the production tubing.

The present invention allows access through the tubing into a much longer annular chamber that is now disposed along a joint in the tubing string and no longer tied to the short space available within a pin and box connection, as in the past. As a result, a specific landing shoulder is no longer required and the target range for penetration has been increased from about ½ inch to lengths over 1 inch to lengths of 6-10 feet or longer. These and other advantages of the present invention will be more apparent to those skilled in the art from a review of the description of the preferred embodiment and the drawings which appear below with the appended claims defining the full scope of the invention.

SUMMARY OF THE INVENTION

Access to a downhole tool through a tubular wall is created with a penetration tool into a surrounding annular chamber. The chamber is disposed around a tool joint between the end connection leaving an annular chamber that is of considerable length and allowing penetration anywhere along such length. The need to precisely position the penetration tool, as in past designs of annular chambers disposed within a pin and box connection is eliminated. Landing shoulders for the penetrating tool are also not required as the long length of the annular chamber allows surface personnel to sufficiently and accurately place the penetration tool somewhere along the length of the annular chamber.

BRIEF DESCRIPTION OF THE DRAWING

FIG. 1 is a section view showing the annular chamber between end connections of a stand of tubulars.

DETAILED DESCRIPTION OF THE PREFERRED EMBODIMENT

A tubular stand 10 has a bottom sub 12 and a top sub 14 that are attached at threads 16 and 18 respectively. Threads 20 and 22 connect stand 10 to a tubing string that is not shown. A downhole tool that is also not shown can be attached at threads 20 or/and 22 or further away in either or both directions, as needed. An outer housing 24 is secured to top sub 14 and bottom sub 12 in a sealed manner optionally using an o-ring seal 26 for such a purpose. A exit port 28 is shown through the top sub 14 and it is connected, as shown schematically in the Figure through a conduit 29 to a downhole tool T. Exit port 28 can alternatively be in bottom sub 12 as an alternate position or an additional position so that a tool T can be accessed from bore 30 via annular space 32 when a penetration is made in the wall of tubular stand 10 using a penetrating tool (not shown) that is known in the art.

The advantage of this design over the prior designs that had the annular chamber in the pin and box connection at a tubular end is that the length of the annular chamber 32 can be made far longer limited only by the length of the tubular 10 between the subs 12 and 14. Even a shorter than standard joint, referred to as a pup joint, can provide chamber lengths of 6-10 feet or more. Because of this long target length to make a penetration, the need to land the penetration tool on a landing shoulder to properly space out its penetrating component is eliminated. In the past it has been difficult to properly land such a tool after a long period of service as well contaminants such as paraffin prevented access to the landing shoulder and were the cause of penetration tool failure due to such misalignment or worse a penetration made in the wrong place. Now with the present invention, the target range for penetration is so long that a landing shoulder is not required. Surface personnel can gauge that they are in the target range from the surface without the need to land on a locating shoulder. The risk of penetrating in the wrong place is virtually eliminated.

It should be noted that the chamber 32 can be initially filled with an incompressible fluid and a thermal compensation feature can be provided at the tool T to relive the pressure generated through thermal gradients such as through a weep hole adjacent a piston that is ultimately operated when the chamber 32 is penetrated and pressurized by increasing the pressure in bore 30. One such application of the present invention is in conjunction with an external packer for a production string that is released by piston movement where the piston is exposed to chamber 32 and is urged to move when the chamber 32 is penetrated and subsequently pressurized. A wide variety of other tools can be operated with the present invention and the long length provided for chamber 32 facilitates entry into the chamber for operation of the tool.

While a single stand of pipe 10 is illustrated, the chamber 32 can extend over several stands 10 that are joined together such as by threading, for example.

The above description is illustrative of the preferred embodiment and many modifications may be made by those skilled in the art without departing from the invention whose scope is to be determined from the literal and equivalent scope of the claims below:

We claim:

1. A tubular assembly apparatus in combination with a downhole tool and a penetrating tool for providing access to operate the downhole tool through an inner wall of the apparatus, comprising:

the downhole tool operable with internal pressure;

at least one stand of tubular having a wall defining a bore therethrough and spaced apart end connections and further comprising an annular chamber having an exit port and formed by a surrounding outer tubular circumscribing said tubular and extending between said end connections said chamber containing and delivering pressure to said downhole tool through a pressurized conduit, said conduit extending from said exit port to said downhole tool located remotely from said chamber the penetrating tool;

said penetrating tool can penetrate at a choice of desired axially spaced locations into said chamber, so that the downhole tool can be pressurized to operate from said bore through pressure transmitted to the downhole tool through the penetration made into said chamber.

2. The apparatus of claim 1, wherein:

said chamber extends for over 1 inch between said end connections.

3. The apparatus of claim 1, wherein:

said chamber extends for over 6 feet between said end connections.

4. The apparatus of claim 1, wherein:

said bore is devoid of a landing shoulder for a penetrating tool used to penetrate said wall.

5. The apparatus of claim 1, wherein:

said end connections are disposed at opposed ends of a single stand of tubular.

6. The apparatus of claim 1, wherein:

said end connections are disposed at opposed ends of a string of connected tubulars.

7. The apparatus of claim 1, wherein:

said end connections are adapted to connect to another end connection or another tubular without defining a chamber at that connection.

8. A method of operating a downhole tool, comprising:

assembling the tool that operates on internal pressure on a string;

providing at least one stand in the string with an external pressure containing chamber having an exit port and defined by an outer tubular that runs between spaced end connections on said stand;

providing pressurized fluid communication between said chamber and the downhole tool, said downhole tool located beyond said exit port;

penetrating the wall of the stand into said chamber at a choice of desired axially spaced locations without penetrating said outer tubular;

operating the tool remotely located from said exit port via a conduit from said exit port with internal pressure delivered to the tool from the penetration and through said chamber.

9. The method of claim 8, comprising:

providing a long enough chamber so that a penetrating tool does not need a landing shoulder in the stand for proper positioning.

10. The method of claim 8, comprising:

making the chamber over 1 inch long.

11. The method of claim 8, comprising:

making the chamber over 6 feet long.

12. The method of claim 8, comprising:

providing a chamber that spans a plurality of stands.

13. The method of claim 8, comprising:

providing thermal compensation for fluid initially in said chamber.

* * * * *